US009933801B1

(12) United States Patent
Guan et al.

(10) Patent No.: US 9,933,801 B1
(45) Date of Patent: Apr. 3, 2018

(54) POWER DEVICE AREA SAVING BY PAIRING DIFFERENT VOLTAGE RATED POWER DEVICES

(71) Applicant: QUALCOMM Incorporated, San Diego, CA (US)

(72) Inventors: Hua Guan, San Diego, CA (US); Ngai Yeung Ho, San Diego, CA (US); Mengmeng Du, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/473,504

(22) Filed: Mar. 29, 2017

Related U.S. Application Data

(60) Provisional application No. 62/425,506, filed on Nov. 22, 2016.

(51) Int. Cl.
*G05F 1/59* (2006.01)
*G05F 1/575* (2006.01)

(52) U.S. Cl.
CPC ..... *G05F 1/575* (2013.01)

(58) Field of Classification Search
CPC . G05F 1/59; G05F 1/562; G05F 1/563; G05F 1/565; G05F 1/607; G05F 1/61; G05F 1/618; G05F 1/613; G05F 1/56
See application file for complete search history.

(56) References Cited

U.S. PATENT DOCUMENTS

| | | | | |
|---|---|---|---|---|
| 6,340,918 | B2 | 1/2002 | Taylor | |
| 6,677,735 | B2 * | 1/2004 | Xi | G05F 1/575 323/273 |
| 6,765,374 | B1 | 7/2004 | Yang et al. | |
| 6,861,832 | B2 | 3/2005 | Perez | |
| 7,106,032 | B2 * | 9/2006 | Chen | G05F 1/569 323/269 |
| 7,656,139 | B2 | 2/2010 | Van | |
| 7,893,672 | B2 | 2/2011 | Scoones et al. | |
| 7,932,705 | B2 * | 4/2011 | Kim | G05F 1/561 323/266 |
| 8,207,719 | B2 * | 6/2012 | Shiota | G05F 1/59 323/266 |
| 8,536,844 | B1 * | 9/2013 | Kumar | G05F 1/565 323/269 |
| 2014/0084881 | A1 * | 3/2014 | Shih | G05F 1/56 323/269 |

* cited by examiner

*Primary Examiner* — Gary L Laxton
(74) *Attorney, Agent, or Firm* — Qualcomm Incorporated/Seyfarth Shaw LLP

(57) ABSTRACT

A voltage regulator may include an auxiliary power device having a first terminal coupled to a control line, a second terminal coupled to an input voltage and a third terminal coupled to an output voltage pad. The voltage regulator may also include a main power device electrically coupled in parallel with the auxiliary power device. A second terminal of the main power device may be coupled to the input voltage, and a third terminal of the main power device may be coupled to the output voltage pad. The voltage regulator may further include a switching system selectively coupling the main power device into and out of the voltage regulator.

23 Claims, 7 Drawing Sheets

POWER DEVICE AREA SAVING BY PAIRING DIFFERENT VOLTAGE RATED POWER DEVICES

CROSS-REFERENCE TO RELATED APPLICATION

The present application claims the benefit of U.S. Provisional Patent Application No. 62/425,506, filed on Nov. 22, 2016, and titled "POWER FIELD EFFECT TRANSISTOR (FET) AREA SAVING BY PAIRING DIFFERENT VOLTAGE RATED DEVICES," the disclosure of which is expressly incorporated by reference herein in its entirety.

TECHNICAL FIELD

The present disclosure generally relates to power management integrated circuits (PMICs). More specifically, aspects of the present disclosure relate to PMICs including paired, different voltage rated power devices.

BACKGROUND

Many modern electronic systems rely on one or more batteries for power. The batteries are typically recharged, for example, by connecting the electronic system to a power source (e.g., an alternating current (AC) power outlet) via a power adapter and cable.

A voltage regulator may provide a power supply rail from a battery. A low dropout (LDO) regulator is one type of linear voltage regulator that is popular in battery powered devices. A low dropout voltage regulator is generally designed to provide a stable regulated output voltage rail in situations where the dropout of the voltage regular is less than or equal to a predetermined minimum value. That is, a low dropout voltage regulator supports stable output voltage rail regulation when the difference between the input voltage $V_{IN}$ and a regulated output voltage $V_{OUT}$ is larger than or equal to the predetermined minimum value.

A low dropout regulator may include a power field effect transistor (FET). Power FETs are generally designed to handle significant power levels. In particular, power FETs support a high voltage range, while providing good efficiency. A power FET, therefore, handles a wide range of operating conditions. So, traditionally, power FETs are fabricated using higher voltage rated devices that consume a large area.

SUMMARY

A voltage regulator may include an auxiliary power device having a first terminal coupled to a control line, a second terminal coupled to an input voltage and a third terminal coupled to an output voltage pad. The voltage regulator may also include a main power device electrically coupled in parallel with the auxiliary power device. A second terminal of the main power device may be coupled to the input voltage, and a third terminal of the main power device may be coupled to the output voltage pad. The voltage regulator may further include a switching system selectively coupling the main power device into and out of the voltage regulator.

A method of controlling a low dropout (LDO) regulator including a main power device coupled in parallel with an auxiliary power device may include monitoring an output voltage pad of the LDO regulator. The method may also include selectively coupling the main power device into and out of the LDO regulator according to the monitoring of the output voltage pad of the LDO regulator. The method may further include operating the auxiliary power device at least when the main power device is selectively coupled out of the LDO regulator.

A voltage regulator may include an auxiliary power device having a first terminal coupled to a control line, a second terminal coupled to an input voltage, and a third terminal coupled to an output voltage pad. The voltage regulator may also include a main power device electrically coupled in parallel with the auxiliary power device. A second terminal of the main power device may be coupled to the input voltage, and a third terminal of the main power device may be coupled to the output voltage pad. The voltage regulator may further include a means for selectively coupling the main power device into and out of the voltage regulator.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1:
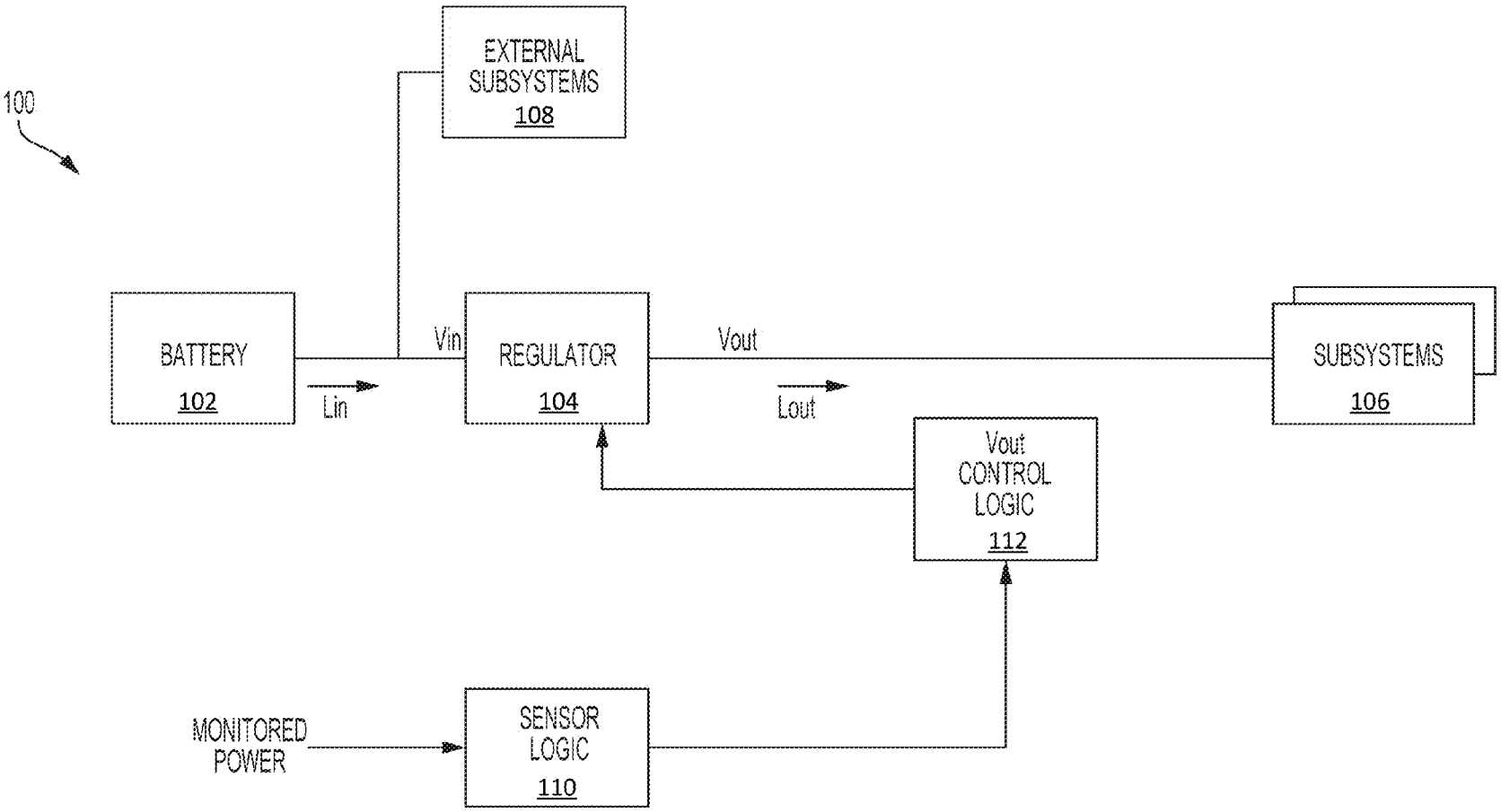
FIG. 1 depicts a simplified system for delivering power in an electronic device according to one aspect of the disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR" and the use of the term "or" is intended to represent an "exclusive OR".

A linear voltage regulator generally produces a regulated direct current (DC) output voltage rail ($V_{OUT}$) from an input supply voltage rail ($V_{IN}$), in which unwanted, excess voltage is dropped across the linear voltage regulator. This excess voltage ($=V_{IN}-V_{OUT}$) is commonly referred to as the "headroom" of the linear voltage regulator. In operation, linear voltage regulators generally operate in a step-down mode, in which the output voltage $V_{OUT}$ is stepped down from the input voltage (e.g., $V_{OUT}<V_{IN}$). The term "dropout" may refer to the minimum headroom value supported by a linear voltage regulator.

A low dropout (LDO) regulator is one type of linear voltage regulator that is popular in battery powered devices, in which the input voltage $V_{IN}$ dips to a level approximately equal, but still greater than the output voltage. A low dropout voltage regulator is designed to provide a stable regulated output voltage rail in situations where the dropout of the voltage regular is less than or equal to a predetermined minimum value. That is, a low dropout voltage regulator supports stable output voltage rail regulation when the difference between the input voltage $V_{IN}$ and a regulated output voltage $V_{OUT}$ is larger than or equal to the predetermined minimum value (e.g., 0.2 volts).

The low dropout regulator may include a power device, such as a power field effect transistor (FET). Power FETs are generally designed to handle significant power levels. In particular, power FETs should support a high voltage range, while providing good efficiency. In many applications, normal operation of a power FET involves a narrower operating range that is suitable for more area efficient, lower voltage rated devices. Under certain conditions, however, a power FET operating point is outside a SOA (safe operating area). These operating conditions include, but are not limited to: (1) start up or shut down operating conditions; and (2) faulty operating conditions, such as OC (over current) or OV (over voltage) conditions. So traditionally, power FETs are fabricated using higher voltage rated devices that consume an increased area relative to lower voltage rated devices.

According to aspects of the present disclosure, a power management integrated circuit (PMIC) including paired, different voltage rated power devices is described. The PMIC combines a higher voltage (mid-voltage) rated power device (e.g., an MV power field effect transistor (FET)) with a lower voltage (LV) rated power device (e.g., an LV power FET). The PMIC includes a mid-voltage (MV) rated device (e.g., an MV power transistor (power FET) as an auxiliary power device. The PMIC also includes a low-voltage (LV) rated device (e.g., an LV power transistor (LV power FET)) as a main power device, electrically coupled in parallel with the auxiliary power device. In this aspect of the present disclosure, the auxiliary power device is a mid-voltage rated power FET that occupies a reduced area relative to the main power device, which is configured as a low-voltage rated power FET.

The auxiliary power device may include a first terminal coupled to a control line, a second terminal coupled to an input voltage, and a third terminal coupled to an output voltage pad. In addition, a second terminal of the main power FET is coupled to the input voltage, and a third terminal of the main power FET is coupled to the output voltage pad. In this configuration, operation of the auxiliary power device is controlled to protect the main power device during predetermined operating conditions. The PMIC also includes a switching system selectively coupling the main power device into and out of the PMIC for protection of the main power device. In this arrangement, a first terminal of the main power device is selectively coupled to the control line and the output voltage pad.

The power device described herein (e.g., the auxiliary and main power devices) may be implemented according to an n-channel or n-type configuration (e.g., n-channel metal oxide semiconductor (NMOS) field effect transistors (FETs)) or p-channel configuration (PMOS) FETs). For illustrative purposes, however, some of the transistors described herein are NMOS main and auxiliary power FETs.

In one aspect of the disclosure, the switching system may be implemented as an analog comparator. The analog comparator may receive a second reference voltage and an output voltage. The analog comparator may be configured to selectively couple and decouple the main power device during predetermined operation conditions. These predetermined operating conditions may include, but are not limited to: (1) start up or shut down operating conditions; and (2) faulty operating conditions, such as OC (over current) or OV (over voltage) conditions. In this manner, operation of the PMIC remains within an electrically safe operating range (eSOA). Alternatively, the switching system is composed of a comparator for controlling a first switch and a second switch. The first switch may be arranged between a first terminal of the main power FET and the control line. In addition the second switch may be arranged between the first terminal of the main power device and the output voltage pad.

System Overview

FIG. 1 depicts a system 100 for delivering power in an electronic device according to one aspect of the disclosure. The system 100 includes a battery 102 that may provide a power supply voltage from outside a chip including a regulator 104. The regulator 104 may deliver a power supply voltage (e.g., a voltage rail) from the battery 102 to different subsystems 106. Also, external subsystems 108 may be located external to the chip that includes the regulator 104. The external subsystems 108 may not draw power from the regulator 104, but may still draw power from the battery 102.

The system 100 may be part of an electronic device, such as a cellular phone, tablet, or other mobile device. In one aspect, the regulator 104 is highly integrated in the electronic device with the subsystems 106 and the external subsystems 108. The regulator 104 may be a buck regulator, a boost regulator, and/or a buck-boost regulator. The regulator 104 regulates the output voltage Vout from the regulator 104 to different subsystems 106. For example, in boost mode, the regulator 104 may increase the level of an input voltage Vin that is received from the battery 102. Also, in buck mode, the regulator 104 may decrease the level of the input voltage Vin that is received from the battery 102.

The system 100 includes subsystems 106 (e.g., loads) that draw power from the regulator 104. These subsystems 106 may have different minimum power supply voltage specifications. For example, the minimum operating voltage may be a level below which the subsystems may no longer operate properly. The subsystems 106 may draw different levels of power (e.g., current and/or voltage) at different times depending on the operations the subsystems are performing. Further, different subsystems may draw power at different times, such as a subsystem may draw power when actively performing an operation, but not draw a lot of power when idle. Sensor logic 110 and Vout control logic 112 may be provided to adjust the output voltage Vout such that the regulator 104 is able to provide sufficient power to subsystems 106. The sensor logic 110 and the Vout control logic 112 may be part of the regulator 104.

Figure 2:
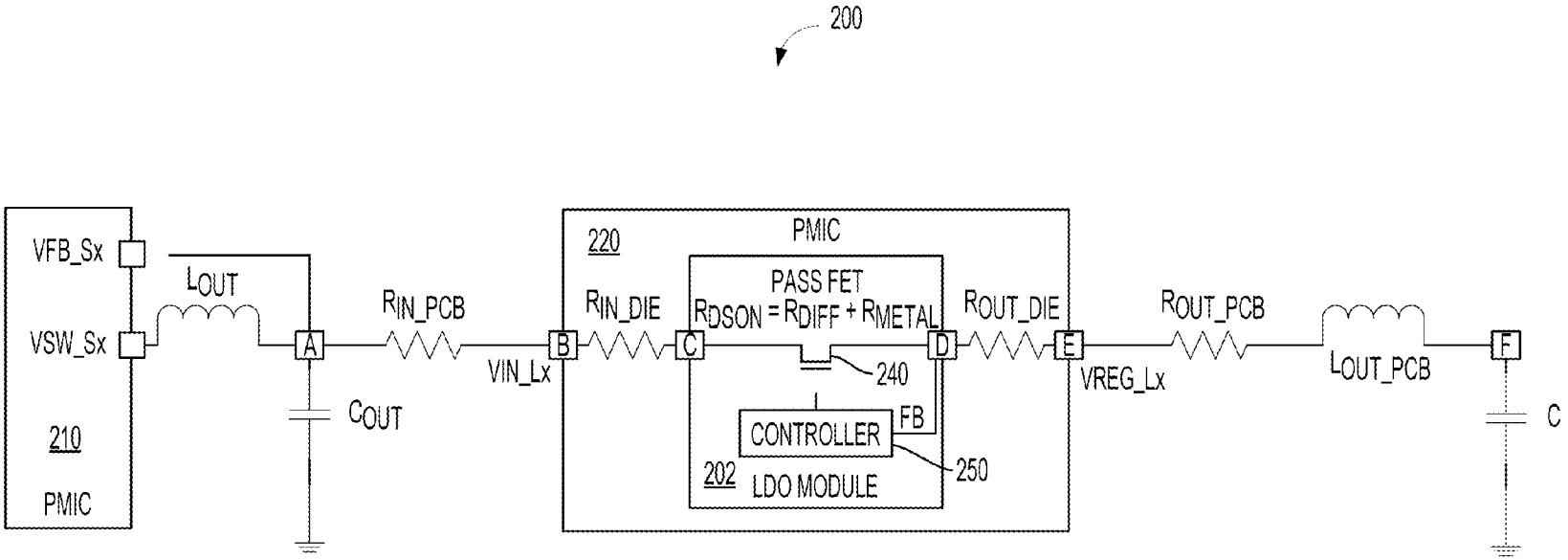
FIG. 2 illustrates a power management module system including a low dropout (LDO) regulator according to one aspect of the disclosure.

FIG. 2 illustrates a low dropout (LDO) regulator implemented as part of a power management module system 200 (e.g., power management integrated circuit (PMIC)). The power management module system 200 includes a primary voltage regulator 210 and a power management integrated circuit (PMIC) 220. The power management module system 200 also includes an LDO module 202 in the PMIC 220, an LDO controller 250, and a power FET 240 of the LDO module 202. The power management module system 200 further includes a low pass filter including an inductor ($L_{out}$) and a capacitor ($C_{out}$), parasitic resistances ($R_{in_PCB}$ and $R_{out_PCB}$) of a printed circuit board (PCB) supporting the primary voltage regulator 210, and the PMIC 220. A parasitic inductance ($L_{out_PCB}$) of the PCB, and parasitic resistances ($R_{in_die}$ and $R_{out_die}$) of the die on which the PMIC 220 is fabricated and also shown. The power management module system 200 also includes input and output nodes of the PMIC 220 (e.g., nodes B and E), as well as input and output nodes of the LDO module 202 (e.g., nodes C and D). The power management module system 200 also includes an output capacitor, C, at an output node, F. The output capacitor maintains loop stability and keeps an output voltage of the LDO module relatively constant. For example, the output capacitor keeps the output voltage of the LDO module relatively constant during load transients.

As noted, the power FET 240 of the LDO module 202 is generally designed to handle significant power levels. Meeting these significant power levels generally involves fabricating the power FET 240 using a higher voltage rated device that consumes an increased area relative to a lower voltage rated device. In many applications, however, normal operation of the power FET 240 involves a narrower operating range that is suitable for a more area efficient, lower voltage rated device.

Figure 3:
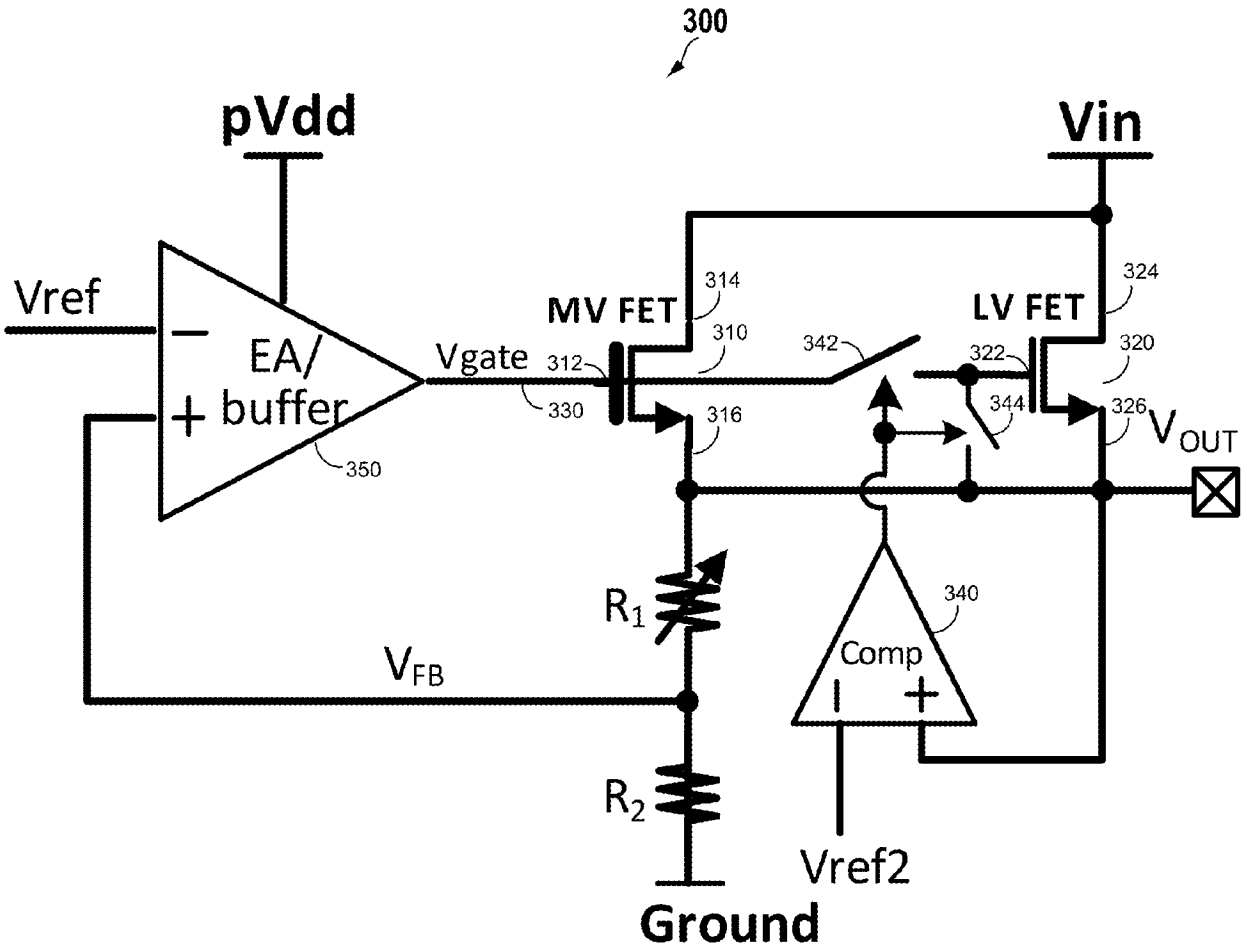
FIG. 3 illustrates a voltage regulator that combines an auxiliary power device and a main power device according to aspects of the present disclosure.

According to aspects of the present disclosure, a power management integrated circuit (PMIC), including paired, different voltage rated devices, is described. FIG. 3 shows a voltage regulator 300 (e.g., a low dropout (LDO) regulator) that combines an auxiliary power device 310 and a main power device 320 according to aspects of the present disclosure. In this arrangement, the voltage regulator 300 combines a higher voltage (mid-voltage (MV)) rated power device (e.g., a MV power field effect transistor (FET) (MVFET)) with a lower voltage (LV) rated power device (e.g., an LV power FET (LVFET)).

Representatively, the voltage regulator 300 includes the mid-voltage rated power device MVFET as the auxiliary power device 310, such as an auxiliary power field effect transistor (FET). The voltage regulator 300 also includes the low-voltage rated power device, such as a low-voltage (LV) rated power field effect transistor (FET) (e.g., the LVFET) as the main power device 320 (e.g., a main power field effect transistor (FET)). In this arrangement, the main power device 320 is electrically coupled in parallel with the auxiliary power device 310 (e.g., a mid-voltage (MV) rated power FET).

The auxiliary power device 310 (MVFET) includes a first terminal 312 coupled to a control line 330, a second terminal 314 coupled to an input voltage Vin, and a third terminal 316 coupled to an output voltage pad Vout. The control line 330 is coupled to an error amplifier 350 (e.g., an EA/buffer). The error amplifier 350 operates according to a bias voltage pVdd and generates a gate voltage Vgate on the control line 330 in response to a reference voltage Vref and a feedback voltage $V_{FB}$. The feedback voltage $V_{FB}$ is provided through voltage divider resistors (R1 and R2) coupled between the third terminal 316 of the auxiliary power device 310 and ground. In contrast to the auxiliary power device 310, the main power device 320 (LVFET) is selectively coupled to the voltage regulator 300. In this aspect of the present disclosure, the auxiliary power device 310 MVFET occupies a reduced area relative to the main power device 320 LVFET.

In this arrangement, a second terminal 324 of the main power device 320 is coupled to the input voltage Vin, and a third terminal 326 of the main power device 320 is coupled to the output voltage pad Vout. The voltage regulator 300 includes a switching system for selectively coupling the main power device 320 into and out of the voltage regulator 300 for protection of the main power device 320. In this arrangement, a first terminal 322 of the main power device 320 is selectively coupled to the control line 330 through a first switch 342 and selectively coupled to the output voltage pad Vout through a second switch 344. In this configuration, operation of the first switch 342 and second switch 344 is controlled by a comparator 340 according to Vout and a second reference voltage Vref2 to protect the main power device 320 during predetermined operating conditions, for example, as shown in FIGS. 4A and 4B.

In the configuration shown in FIG. 3, the main power device 320 and the auxiliary power device 310 are of the same type of power FET. In an alternative configuration, the main power device 320 and the auxiliary power device 310 are of a different type of power FET. In this alternative configuration, the switching system of the voltage regulator 300 includes a first control loop for a main voltage regulator including a power FET of a first type. The switching system also includes a second control loop for an auxiliary voltage regulator including a power FET of a second type. In this alternative arrangement, the auxiliary voltage regulator is a smaller regulator including an MV power FET, and the main voltage regulator is a larger regulator including an LV power FET. That is, this arrangement pairs two voltage regulators of different power FET types instead of two power FETs of the same power FET type.

Figure 4A:
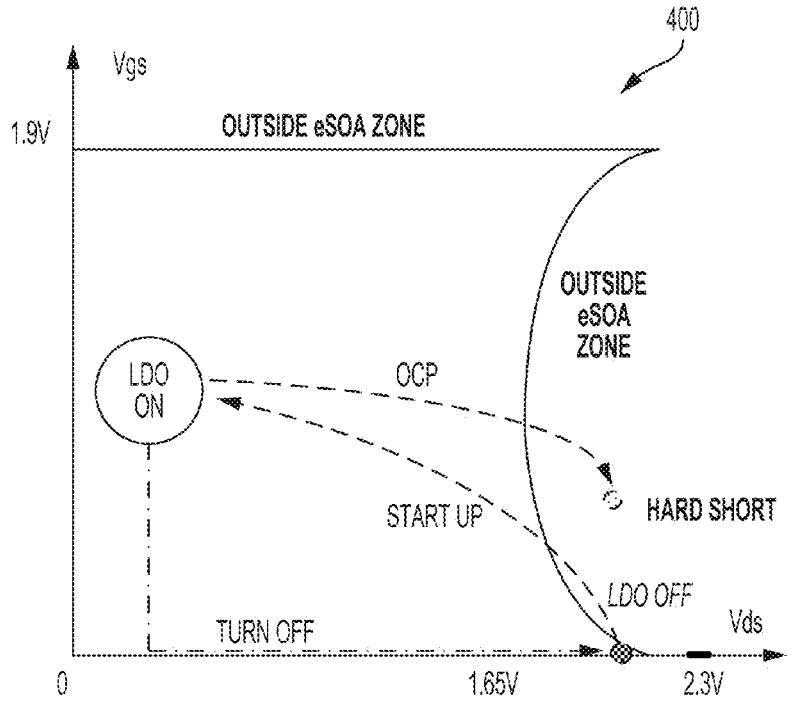
FIGS. 4A and 4B are graphs illustrating power device operation inside and outside of an electrically safe operating area (eSOA) according to aspects of the present disclosure.
Figure 4B:
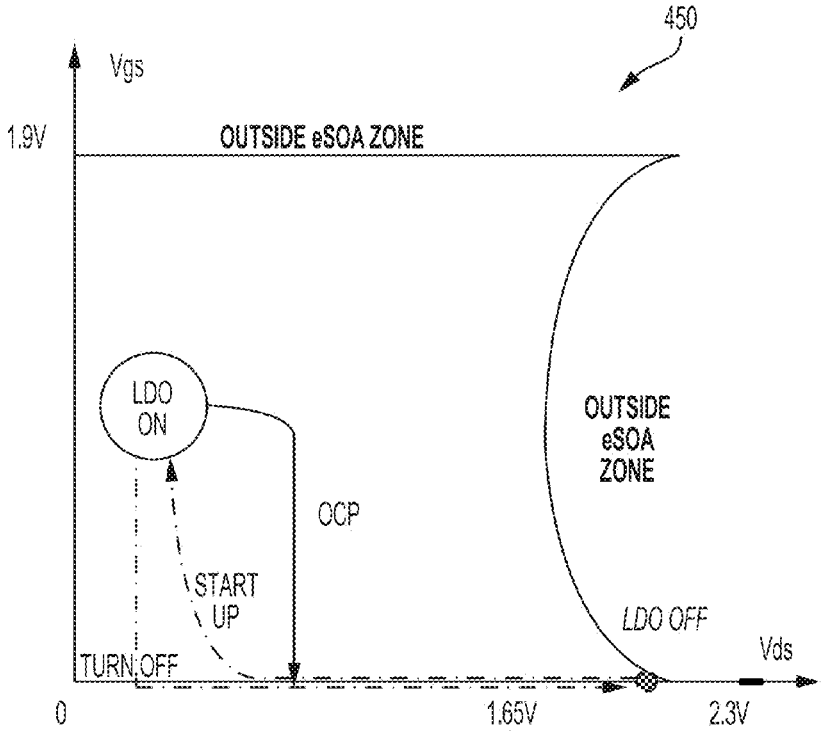

FIGS. 4A and 4B are graphs illustrating power device operation inside and outside of an electrically safe operating area (eSOA) according to aspects of the present disclosure. In these graphs, an LDO on state indicates a desired operating point of the main power device 320. FIG. 4A illustrates a drain source voltage (Vds) versus gate source voltage (Vgs) graph 400 showing operation of the main power device 320 outside an electrically safe operating area (eSOA) according to aspects of the present disclosure. Under certain conditions, an operating point of, for example, the voltage regulator 300 may fall outside an electrically safe operating area (eSOA) if implemented with a lower voltage rated device, such as the LVFET (main power device 320). These operating conditions include, but are not limited to: (1) start up or shut down operating conditions; and (2) faulty operating conditions, such as OC (over current) or OV (over voltage) conditions.

TABLE 1

Power FET Safe Operating Ranges

| Device | Nominal operating VDS (V) | Max. operating VDS (V) | Max hold off VDS @ VGS = 0 V (V) | Max operating VGS (V) |
|---|---|---|---|---|
| 1.5 V NMOS | 1.5 | 1.8 | 3.3 | 1.65 |
| 1.5 V PMOS | 1.5 | 1.8 | 3.3 | 1.65 |
| 1.8 V NMOS | 1.8 | 1.9 | 3.3 | 1.90 |
| 1.8 V PMOS | 1.8 | 1.9 | 3.3 | 1.90 |

Table 1 illustrates exemplary nominal and maximum safe operating ranges for n-type metal oxide semiconductor (MOS) (NMOS) and p-type MOS (PMOS) devices that may be used to implement the main power device 320 (LVFET) and/or the auxiliary power device 310 (MVFET). In the configuration shown in FIG. 3, the main power device 320 (LVFET) and/or the auxiliary power device 310 (MVFET) are implemented using NMOS power FETs. It should be recognized that the main power device 320 (LVFET) and/or the auxiliary power device 310 (MVFET) may be implemented using PMOS power FETs or other like power devices.

Referring again to FIG. 4A, during start up (e.g., LDO off) of the voltage regulator 300, an input voltage of the voltage regulator 300 may be 2.15 volts or higher. Assuming the main power device is implemented as a NMOS power FET, the 2.15 volts exceed the maximum operating drain to source voltage (VDS), resulting in a large drain source current Ids as well as a large gate source voltage Vgs, which may damage the main power device 320. That is, the main power device 320 may shut down when its operating point is outside the eSOA during start up as well as shutdown. Similarly, the main power device 320 may shut down when its operating point is outside the eSOA due to a hard short. For example, a hard short condition is detected when the output voltage Vout is hard shorted to ground, forcing the drain source voltage Vds to the input voltage Vin. Unfortunately, forcing the drain source voltage Vds to the input voltage Vin exceeds the maximum operating drain source voltage Vds of the main power device 320 (see Table 1).

FIG. 4B illustrates a drain source voltage Vds versus a gate source voltage Vgs graph 450 showing operation of the main power device 320 within an electrically safe operating area (eSOA) according to aspects of the present disclosure. This aspect of the present disclosure uses a small, parallel coupled high voltage rated device (e.g., the MVFET) to extend the range of a larger, lower voltage rated device (e.g., the LVFET). During a startup event, the auxiliary power device 310 is turned on, while the main power device 320 is selectively coupled outside the voltage regulator 300 until the gate source voltage Vgs reaches a predetermined value (e.g., 1.25 volts), thereby reducing the drain source voltage Vds before turning on the main power device 320.

Overcurrent protection (OCP) for the main power device 320 is also provided. For example, an overcurrent protection OCP event is detected when the output voltage Vout of the voltage regulator 300 falls below a predetermined value (e.g., 1.25 volts). During an overcurrent protection OCP event, the main power device 320 is selectively coupled out of the voltage regulator 300. Selectively coupling the main power device 320 out of the voltage regulator 300 forces the gate source voltage Vgs to zero to protect the main power device 320.

Figure 5:
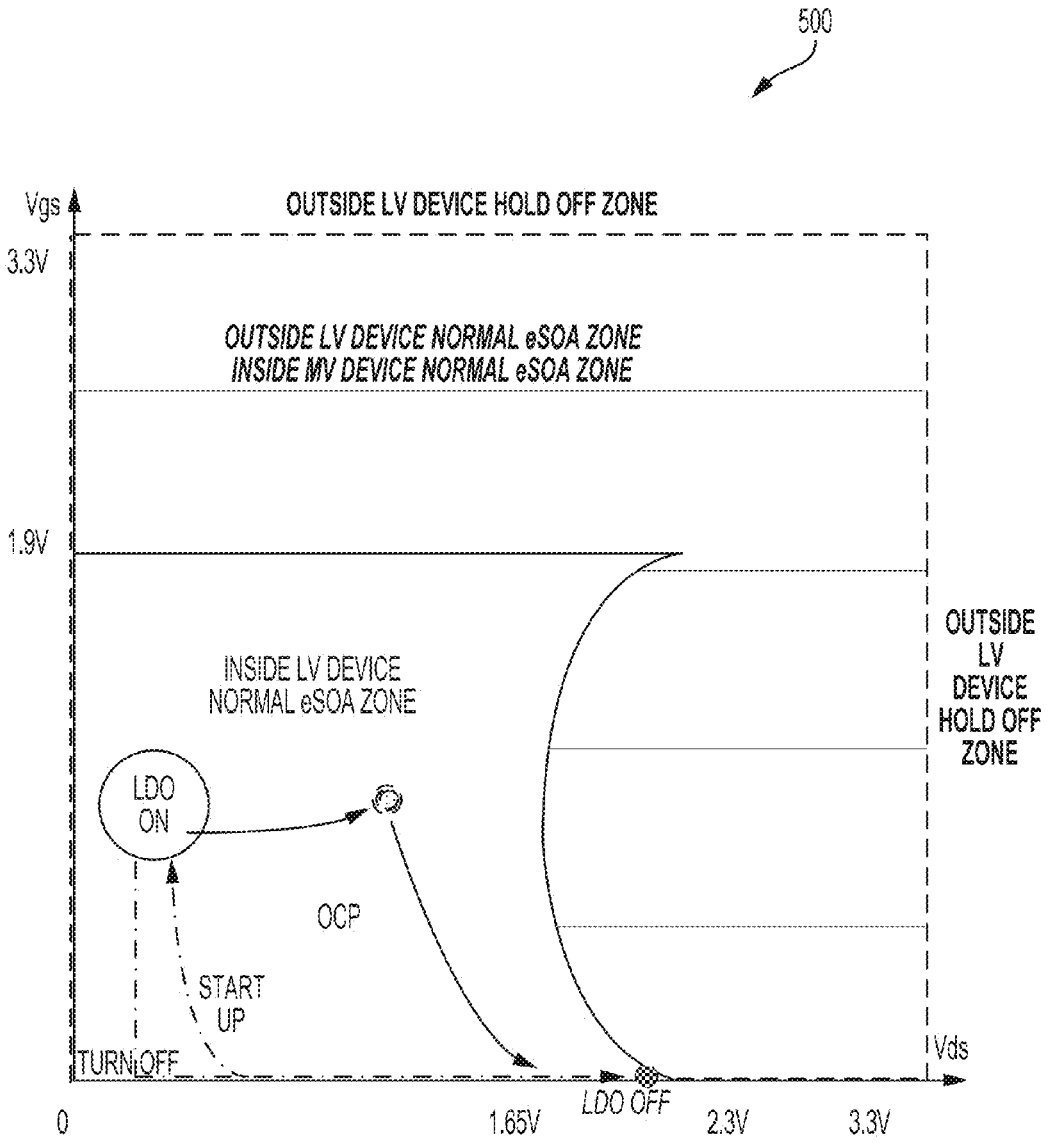
FIG. 5 illustrates a drain source voltage Vds versus a gate source voltage Vgs graph illustrating an extended operating area of a voltage regulator by pairing a main power device with an auxiliary power device according to aspects of the present disclosure.

FIG. 5 illustrates a drain source voltage Vds versus a gate source voltage Vgs graph 500 showing an extended operation of the voltage regulator by pairing the main power device 320 with the auxiliary power device 310 according to aspects of the present disclosure. Representatively, an inner portion of the graph 500 is similar to the electrically safe operating area (eSOA) shown in the graph 450 of FIG. 4B. The graph 500, however, illustrates an eSOA of the auxiliary power device 310 superimposed on the eSOA of the main power device 320. In this example, the operating range of the voltage regulator 300 is extended by increasing the drain source voltage Vds from 2.3 volts to 3.3 volts. Similarly, the gate source voltage Vgs is increased from 1.9 volts to 3.3 volts by selectively operating the main power device 320 in combination with the auxiliary power device 310.

By pairing a smaller, mid-voltage rated power FET (e.g., MVFET) as the auxiliary power device 310, with a larger, low-voltage rated power FET (e.g., LVFET) as the main power device 320, the operating range of the voltage regulator 300 is significantly extended. Furthermore, the operating range of the voltage regulator 300 is extended by using an MVFET as the auxiliary power device 310, which consumes a reduced area relative to an LVFET. In one aspect of the present disclosure, the reduced size of the auxiliary power device 310 enables fabrication of the comparator 340, the first switch 342, the second switch 344, and the auxiliary power device 310 on an add-on sub-block.

Figure 6:
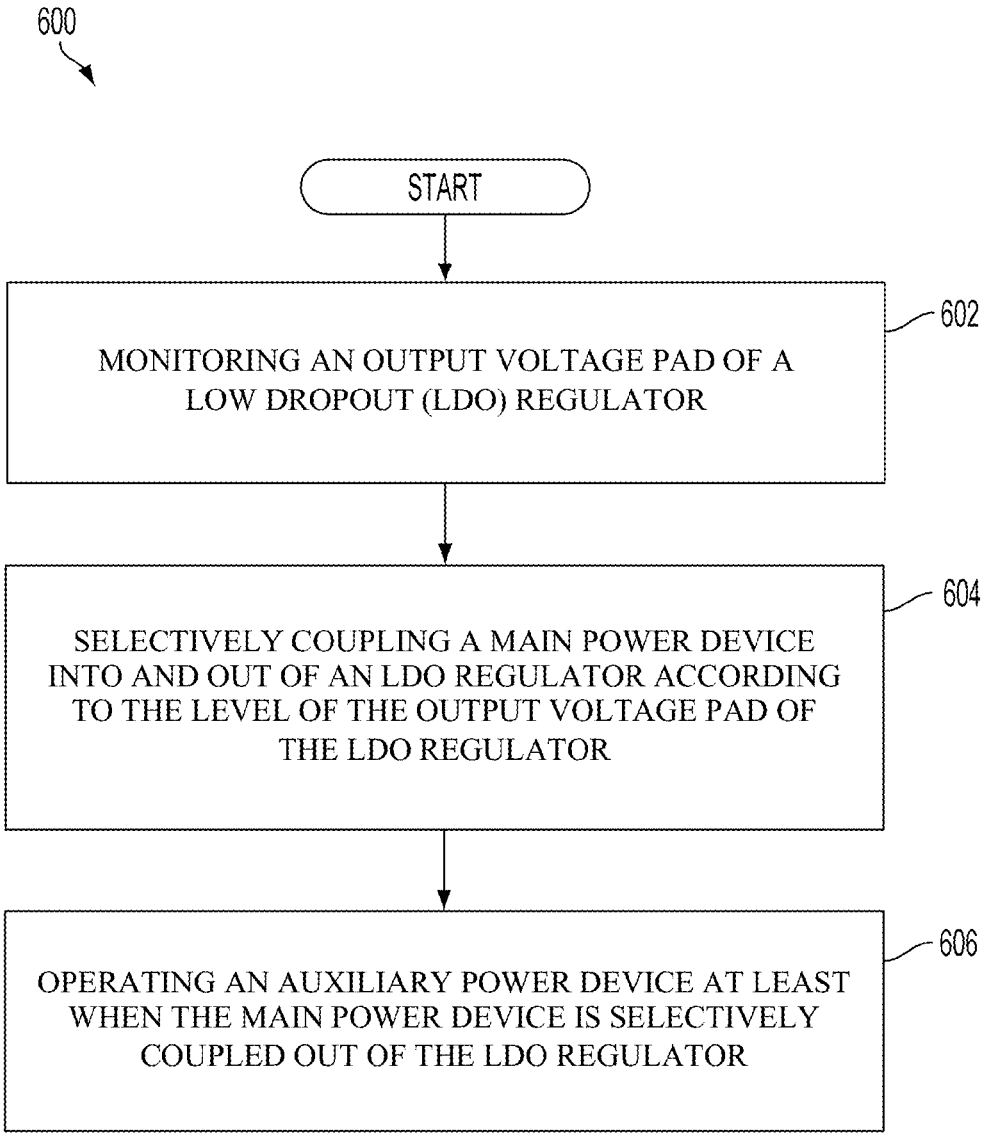
FIG. 6 depicts a simplified flowchart of a method for operating a low dropout (LDO) regulator including paired, different voltage rated power devices, according to aspects of the disclosure.

FIG. 6 depicts a flowchart of a method 600 of controlling a low dropout (LDO) regulator including a main power device coupled in parallel with an auxiliary power device, according to aspects of the disclosure. The method 600 begins at block 602, in which an output voltage pad of the LDO regulator is monitored against predetermined thresholds. For example, as shown in FIG. 3, the output voltage Vout of the voltage regulator 300 corresponds to the drain source voltage Vds of the main power device 320. At block 604, the main power device is selectively coupled into and out of the LDO regulator according to the level of the output voltage pad of the LDO regulator (e.g., being above or below a predetermined threshold). For example, an overcurrent protection OCP event is detected when the output voltage Vout of the voltage regulator 300 falls below a predetermined value (e.g., 1.25 volts). At block 606, the auxiliary device is operated at least when the main power device is selectively coupled out of the LDO regulator. During this overcurrent protection OCP event, the main power device 320 is selectively decoupled from the voltage regulator 300 while the drain source voltage Vds is reduced by operating the auxiliary power device 310.

According to a further aspect of the present disclosure, a low dropout voltage regulator including an auxiliary power FET coupled in parallel with a main power FET is described. The low dropout voltage regulator includes means for selectively coupling the main power FET into and out of the LDO regulator. The selectively coupling means may be a switching system. In another aspect, the aforementioned means may be any layer, module, or any apparatus configured to perform the functions recited by the aforementioned means.

Figure 7:
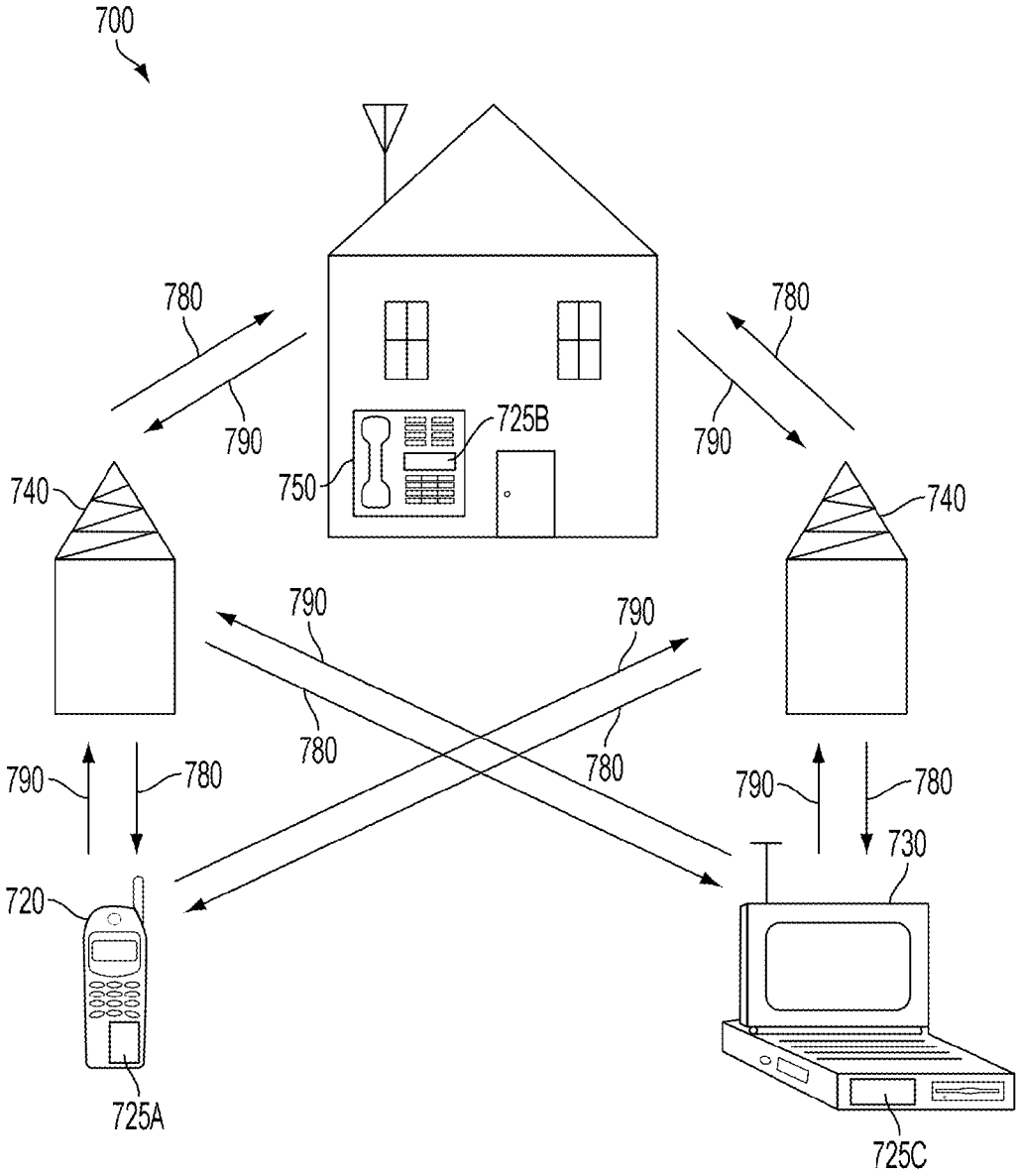
FIG. 7 is a block diagram showing an exemplary wireless communication system in which an aspect of the disclosure may be advantageously employed.

FIG. 7 is a block diagram showing an exemplary wireless communication system 700 in which an aspect of the disclosure may be advantageously employed. For purposes of illustration, FIG. 7 shows three remote units 720, 730, and 750 and two base stations 740. It will be recognized that wireless communication systems may have many more remote units and base stations. Remote units 720, 730, and 750 include IC devices 725A, 725C, and 725B that include the disclosed paired auxiliary and main power FETs. It will be recognized that other devices may also include the disclosed paired power FETs, such as the base stations, switching devices, and network equipment. FIG. 7 shows forward link signals 780 from the base station 740 to the remote units 720, 730, and 750 and reverse link signals 790 from the remote units 720, 730, and 750 to base station 740.

In FIG. 7, remote unit 720 is shown as a mobile telephone, remote unit 730 is shown as a portable computer, and remote unit 750 is shown as a fixed location remote unit in a wireless local loop system. For example, a remote units may be a mobile phone, a hand-held personal communication systems (PCS) unit, a portable data unit such as a personal digital assistant (PDA), a GPS enabled device, a navigation device, a set top box, a music player, a video player, an entertainment unit, a fixed location data unit such as a meter reading equipment, or other communications device that stores or retrieve data or computer instructions, or combinations thereof. Although FIG. 7 illustrates remote units according to the aspects of the disclosure, the disclosure is not limited to these exemplary illustrated units. Aspects of the disclosure may be suitably employed in many devices, which include the disclosed paired power FETs.

For a firmware and/or software implementation, the methodologies may be implemented with modules (e.g., procedures, functions, and so on) that perform the functions described herein. A machine-readable medium tangibly embodying instructions may be used in implementing the methodologies described herein. For example, software codes may be stored in a memory and executed by a processor unit. Memory may be implemented within the processor unit or external to the processor unit. As used herein, the term "memory" refers to types of long term, short term, volatile, nonvolatile, or other memory and is not to be limited to a particular type of memory or number of memories, or type of media upon which memory is stored.

If implemented in firmware and/or software, the functions may be stored as one or more instructions or code on a computer-readable medium. Examples include computer-readable media encoded with a data structure and computer-readable media encoded with a computer program. Computer-readable media includes physical computer storage media. A storage medium may be an available medium that can be accessed by a computer. By way of example, and not limitation, such computer-readable media can include RAM, ROM, EEPROM, CD-ROM or other optical disk storage, magnetic disk storage or other magnetic storage devices, or other medium that can be used to store desired program code in the form of instructions or data structures and that can be accessed by a computer; disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

In addition to storage on computer-readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a substrate or electronic device. Of course, if the substrate or electronic device is inverted, above becomes below, and vice versa. Additionally, if oriented sideways, above and below may refer to sides of a substrate or electronic device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration.

The steps of a method or algorithm described in connection with the disclosure may be embodied directly in hardware, in a software module executed by a processor, or in a combination of the two. A software module may reside in RAM, flash memory, ROM, EPROM, EEPROM, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general-purpose or special-purpose computer. By way of example, and not limitation, such computer-readable media can include RAM, ROM, EEPROM, CD-ROM or other optical disk storage, magnetic disk storage or other magnetic storage devices, or any other medium that can be used to carry or store specified program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD) and Blu-ray disc where disks usually reproduce data magnetically, while discs reproduce data optically with lasers. Combinations of the above should also be included within the scope of computer-readable media.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "a step for."

What is claimed is:

1. A voltage regulator, comprising:

an auxiliary power device having a first terminal coupled to a control line, a second terminal coupled to an input voltage and a third terminal coupled to an output voltage pad;

a main power device electrically coupled in parallel with the auxiliary power device, a first terminal of the main power device selectively coupled to the control line and selectively coupled to the output voltage pad, a second terminal of the main power device coupled to the input voltage and a third terminal of the main power device coupled to the output voltage pad; and a switching system selectively coupling the main power device into and out of the voltage regulator.

2. The voltage regulator of claim 1, in which the main power device comprises a main power field effect transistor (FET) and the auxiliary power device comprises an auxiliary power field effect transistor (FET).

3. The voltage regulator of claim 1, in which the main power device comprises a low-voltage (LV) rated device and the auxiliary power device comprises a mid-voltage (MV) rated device, in which an area occupied by the MV rated device is less than the area occupied by the LV rated device.

4. The voltage regulator of claim 1, in which the switching system is configured to decouple the first terminal of the main power device from the control line and the output voltage pad to protect the main power device.

5. The voltage regulator of claim 1, in which the auxiliary power device and the switching system are on an add-on sub-block.

6. The voltage regulator of claim 1, in which the auxiliary power device and the main power device are of a same power FET type.

7. The voltage regulator of claim 1, in which the auxiliary power device and the main power device are of a different power FET type.

8. The voltage regulator of claim 1, integrated into at least one of a music player, a video player, an entertainment unit, a navigation device, a communications device, a personal digital assistant (PDA), a fixed location data unit, a mobile phone, and a portable computer.

9. A voltage regulator, comprising:

an auxiliary power device having a first terminal coupled to a control line, a second terminal coupled to an input voltage and a third terminal coupled to an output voltage pad;

a main power device electrically coupled in parallel with the auxiliary power device, a second terminal of the main power device coupled to the input voltage and a third terminal of the main power device coupled to the output voltage pad;

a switching system selectively coupling the main power device into and out of the voltage regulator; and a comparator controlling a first switch and a second switch, the first switch coupled between a first terminal of the main power device and the control line, and the second switch coupled between the first terminal of the main power device and the output voltage pad.

10. A method of controlling a low dropout (LDO) regulator including a main power device coupled in parallel with an auxiliary power device, comprising:

monitoring an output voltage pad of the LDO regulator;

selectively coupling the main power device into and out of the LDO regulator according to the monitoring of the output voltage pad of the LDO regulator, a first terminal of the main power device selectively coupled to a control line and selectively coupled to the output voltage pad; and operating the auxiliary power device at least when the main power device is selectively coupled out of the LDO regulator.

11. The method of claim 10, in which selectively coupling comprises:

determining when to couple the control line to the first terminal of the main power device; and determining when to couple the output voltage pad to the first terminal of the main power device to selectively couple the main power device into the LDO regulator.

12. The method of claim 10, in which selectively coupling comprises:

determining when to decouple the control line from the first terminal of the main power device; and determining when to short the first terminal of the main power device to ground to selectively decouple the main power device out of the LDO regulator.

13. The method of claim 10, in which selectively coupling comprises selectively decoupling the main power device out of the LDO regulator when a level at the output voltage pad is above a predetermined threshold.

14. The method of claim 10, in which selectively coupling comprises selectively coupling the main power device into the LDO regulator when a level at the output voltage pad is below a predetermined threshold.

15. The method of claim 10, further comprising integrating the LDO regulator into at least one of a music player, a video player, an entertainment unit, a navigation device, a communications device, a personal digital assistant (PDA), a fixed location data unit, a mobile phone, and a portable computer.

16. A voltage regulator, comprising:

an auxiliary power device having a first terminal coupled to a control line, a second terminal coupled to an input voltage and a third terminal coupled to an output voltage pad;

a main power device electrically coupled in parallel with the auxiliary power device, a first terminal of the main power device selectively coupled to the control line and selectively coupled to the output voltage pad, a second terminal of the main power device coupled to the input voltage and a third terminal of the main power device coupled to the output voltage pad; and means for selectively coupling the main power device into and out of the voltage regulator.

17. The voltage regulator of claim 16, in which the main power device comprises a low-voltage (LV) rated power field effect transistor (FET) and the auxiliary power device comprises a mid-voltage (MV) rated power FET, in which an area occupied by the MV rated power FET is less than the area occupied by the LV rated power FET.

18. The voltage regulator of claim 16, in which the means for selectively coupling is further configured for decoupling the first terminal of the main power device from the control line and the output voltage pad to protect the main power device.

19. The voltage regulator of claim 16, in which the auxiliary power device and the means for selectively coupling are on an add-on sub-block.

20. The voltage regulator of claim 16, in which the auxiliary power device and the main power device are of a same power FET type.

21. The voltage regulator of claim 16, in which the auxiliary power device and the main power device are of a different power FET type.

22. The voltage regulator of claim 16, integrated into at least one of a music player, a video player, an entertainment unit, a navigation device, a communications device, a personal digital assistant (PDA), a fixed location data unit, a mobile phone, and a portable computer.

23. A voltage regulator, comprising:

an auxiliary power device having a first terminal coupled to a control line, a second terminal coupled to an input voltage and a third terminal coupled to an output voltage pad;

a main power device electrically coupled in parallel with the auxiliary power device, a second terminal of the main power device coupled to the input voltage and a third terminal of the main power device coupled to the output voltage pad;

means for selectively coupling the main power device into and out of the voltage regulator; and a comparator controlling a first switch and a second switch, the first switch coupled between a first terminal of the main power device and the control line, and the second switch coupled between the first terminal of the main power device and the output voltage pad.

* * * * *